United States Patent [19]

Oblad et al.

[11] Patent Number: 4,797,559

[45] Date of Patent: Jan. 10, 1989

[54] METHOD AND APPARATUS FOR CONTROLLING A FLOTATION CELL

[75] Inventors: Hayward B. Oblad; Michael G. Nelson, both of Bethel Park; Thomas D. Sandbrook, Eighty Four, all of Pa.

[73] Assignee: Consolidation Coal Company, Pittsburgh, Pa.

[21] Appl. No.: 117,264

[22] Filed: Nov. 6, 1987

[51] Int. Cl.[4] ..... H01J 5/16; H01J 40/14

[52] U.S. Cl. ..... 250/227; 250/574; 356/442

[58] Field of Search ..... 250/573, 574; 356/441, 356/442; 366/127

[56] References Cited

U.S. PATENT DOCUMENTS

| | | | |
|---|---|---|---|
| 3,960,726 | 6/1976 | Peterson | 210/77 |
| 4,037,973 | 7/1977 | Carr | 356/441 |
| 4,040,954 | 8/1977 | Chandler | 210/42 R |
| 4,166,702 | 9/1979 | Okamoto et al. | 356/442 |
| 4,299,495 | 11/1981 | Sawakata et al. | 356/442 |
| 4,366,431 | 12/1982 | Santini | 250/574 |
| 4,576,723 | 3/1986 | Eisenlauer et al. | 210/709 |
| 4,675,116 | 6/1987 | Hoyland | 210/709 |
| 4,697,605 | 10/1986 | Yung | 366/127 |
| 4,707,272 | 11/1987 | Kistler | 210/709 |

FOREIGN PATENT DOCUMENTS

| | | |
|---|---|---|
| 819868 | 9/1959 | United Kingdom . |
| 2182172 | 5/1987 | United Kingdom . |

OTHER PUBLICATIONS

"Brinkman Dipping Probe Colorimeters" (12 pages).
"Great Lakes Instruments, Inc. Model 223 Ultrasonic Cleaners" (4 pages).
"Photoelectric Concentrator for Wet Concentrating Table-Report No. 7623". R. A. Welsh et al., U.S.D.O.I. (7 pages).

*Primary Examiner*—David C. Nelms
*Assistant Examiner*—William L. Oen
*Attorney, Agent, or Firm*—Alan N. McCartney

[57] ABSTRACT

A method and apparatus for determining the reflectivity of the tailings from a coal flotation cell to optimize the cell operation. A photoelectric detector determines the coal content of the tailings and through a process controller; frother and collector addition to the cell is monitored. An ultrasonic energy vibration is periodically transmitted to the detector to remove deposits on the detector to optimize detector operation.

11 Claims, 3 Drawing Sheets

METHOD AND APPARATUS FOR CONTROLLING A FLOTATION CELL

BACKGROUND OF THE INVENTION

Field of the Invention

This invention relates to the method and apparatus for measuring the relative coal to ash content in the tailings of a froth flotation process to monitor the frother addition rate to optimize the coal removal in the flotation cell.

SUMMARY OF THE PRIOR ART

Various methods and apparatus have been employed to control the operating parameters of flotation cells including the addition of frother additives to the cells to optimize the removal of coal in the cell. In this process, impurities such as ash forming minerals which are the unwanted impurities are separated from the combustible materials (coal). One such device is illustrated in U.S. Pat. No. 4,552,651 which discloses a device for measuring the pulp density in the cell to control cell operation. Another conventional method of controlling cell operation is through the visual observation of the hue of gray in the tailings from the cell. A light gray color will indicate a high impurities content and a darker gray will be indicative of a high coal content in the tailings. This visual inspection by the operator and subsequent manual manipulation of the addition of frother to the cell to optimize coal removal is subject to the obvious disadvantage of inconsistency of control and human error.

Other devices such as nuclear densitometers, coriolis effect mass flow detectors, magnetic flowmeters, dual bubbler tube densitometers and X-ray diffraction equipment have been used to monitor the flotation process, however, these devices are complicated and expensive and do not provide a simple physical reading of the coal content in the tailings from the cell to monitor cell operation.

It is, therefore, desirable to obtain a method and apparatus for automatically measuring the flotation tailings for coal content to control the frother addition rate to the flotation cell to optimize coal removal from the cell.

SUMMARY OF THE INVENTION

It is the purpose of this invention to provide the method and apparatus to measure the physical change in the light reflected from the tailings of a coal removal froth flotation cell to control the frother addition rate to the cell to optimize coal removal from the cell.

It is also an object of this invention to provide a photoelectric detector apparatus submerged in the tailings from a froth flotation cell which detects the light reflected from the slurry coming from the cell to control the addition of frother to the cell to optimize coal removal.

It is a further object of this invention to provide a means to maintain optimum operation of a photoelectric detector of the coal content in the tailings from a flotation cell.

DESCRIPTION OF THE PREFERRED EMBODIMENT

In the froth flotation process of removal of fine coal from impurities, a frother additive is mixed with the coal in a flotation cell and the slurry is agitated so that bubbles adhere to the coal and the coal rises to the surface of the cell and is removed. The ash forming impurities travel through the cell and are removed from the opposite end and may be further processed. Often times a collector, such as fuel oil is added to the feed slurry to enhance the attachment of the bubbles to the coal.

An example of such a flotation process is illustrated in commonly owned U.S. Pat. No. 4,552,651 and the disclosure therein is incorporated herein by reference.

Figure 1:
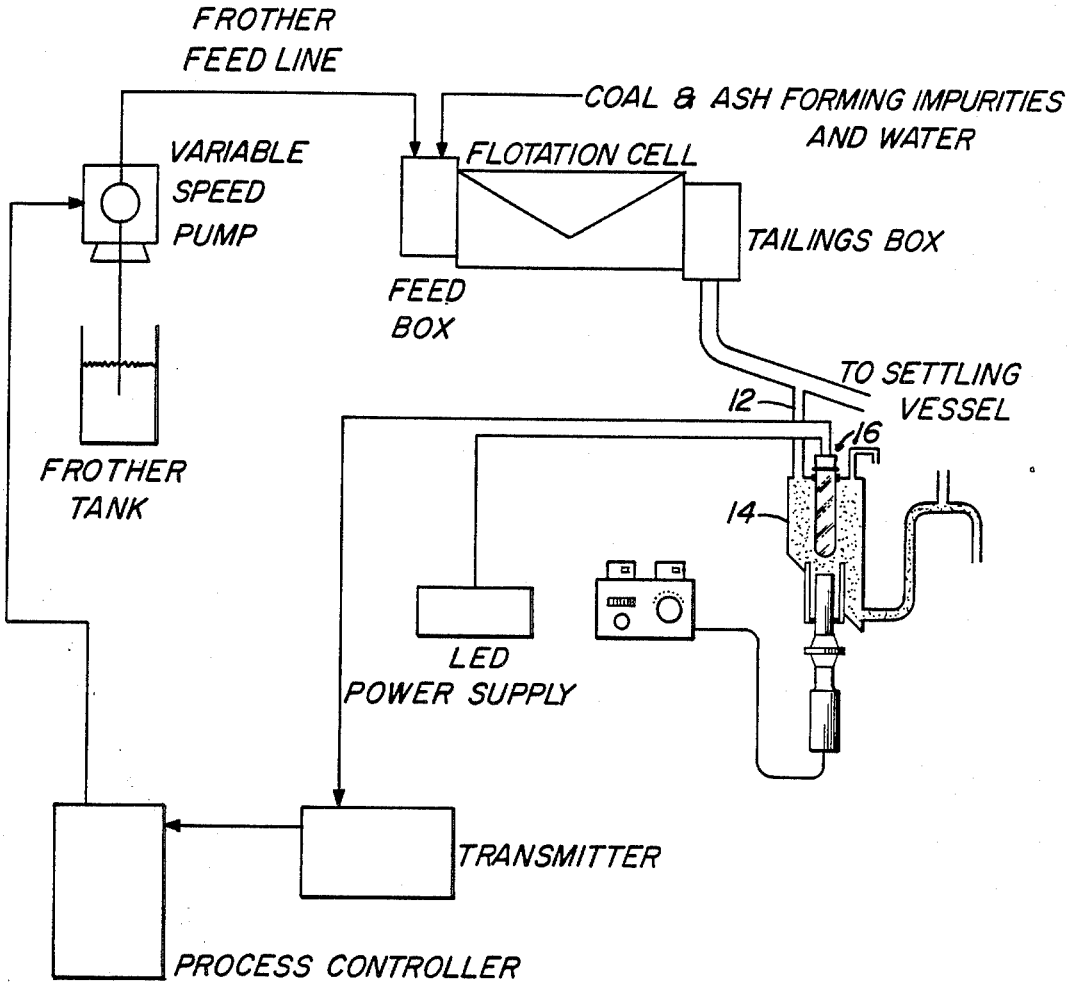
FIG. 1 is a schematic representation of the flotation cell process and the novel method and apparatus for controlling the addition of frother to the cell to optimize the coal/ash forming impurities separation in the cell.

Attention is directed to FIG. 1 which schematically illustrates the flotation cell which receives the coal and ash forming impurities and water through a feed box. Also added to the feed box is a frother. Aeration of the mix in the cell causes the coal to separate by adhering to the bubbles which rise to the surface and are removed. The flotation tailings pass through the cell to the tailings box and are removed to a settling vessel for further processing and disposal.

In this process of separating the coal from the ash forming impurities, the degree of the coal separation can be detected in the tailings. If the tailings are a black color, coal is present in large amounts (coal absorbs light), versus the light gray color of the tailings high in clay content and low in coal amounts. Therefore, it is desirable to obtain an automatic reading of the hue of the tailings to determine the coal/ash forming impurities content of the tailings to indicate that an optimum amount of coal has been removed in the flotation cell. A detector of the change in the hue of gray in the tailings will cause the process controller to signal the variable speed frother supply pump in the line between the frother tank and feed box to supply more or less frother to optimize coal removal in the flotation cell. This signal may also be used to regulate the addition of the fuel oil or other collector to the feed slurry.

The above described system of controlling the flotation cell process is accomplished by placing a photoelectric detector 10 in a canister 14 in a bypass line 12 from the line out of the tailings box. As illustrated in FIGS. 2 to 5, the detector 10 comprises an elongated tube 16 housing a circuit board 18 upon which light emitting diodes (LED) 20 are mounted, surrounding a photoelectric sensor or photoconductor 22 housed in an opaque collar 24 extending from the board outwardly to the inside surface of the tube 16 (see FIGS. 4 and 5). The board 18 is carried on a rod 26 secured in the cap 28 in the end 30 of the tube 16. Wires from the LED's 20 extend through the cap 28 to a regulated power supply.

Figure 5:
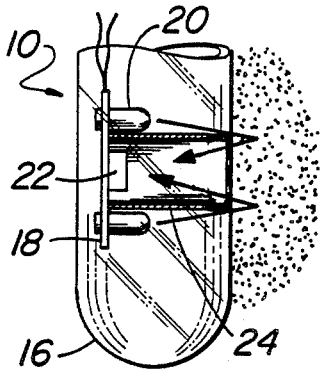
FIG. 5 is a side view partially in section of the detector.
Figure 3:
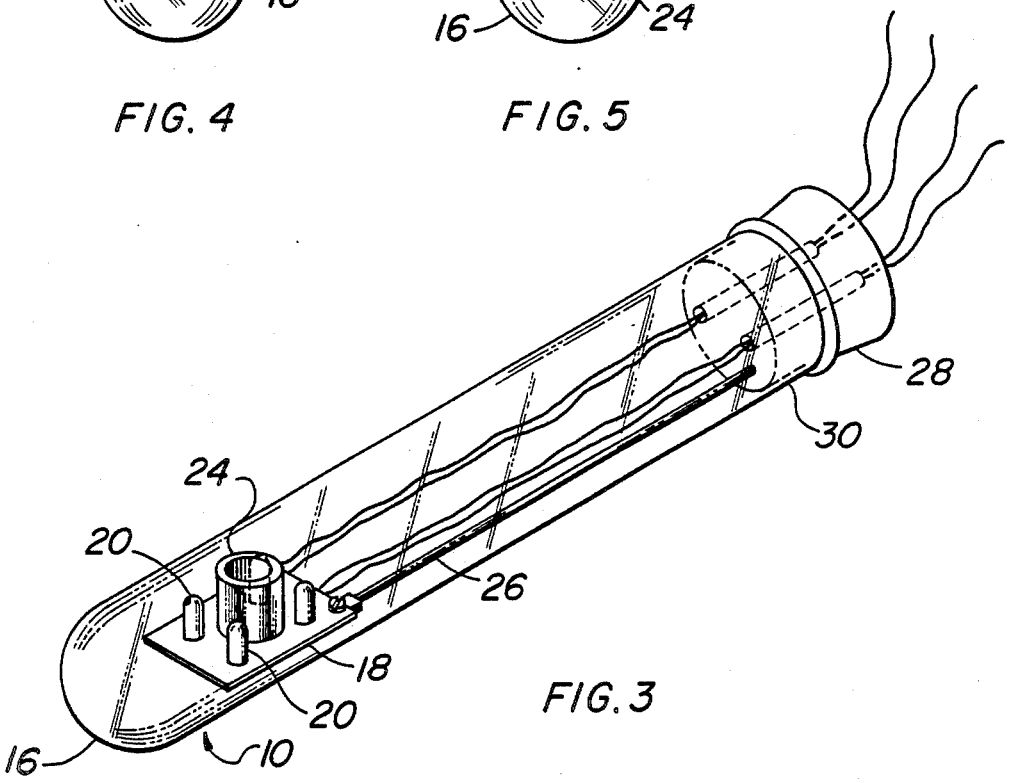
FIG. 3 is a perspective view of the photoelectric detector submersible in the tailings.

In operation, the light emitted from the LED's is backscattered from the coal/ash forming impurities slurry to the photoelectric sensor 22 coupled to a transmitter, see FIGS. 1 and 5.

As the coal content of the tailings increases, the coal absorbs the light and as the coal content decreases, the hue of gray of the tailings lightens, reflecting more light. This variation in coal content will change the amount of backscattered light sensed by the photoconductor. The change in the resistance in the photoelectric sensor causes the voltage of the constant current output transmitter to change, which voltage is passed to the process controller (see FIG. 1) that controls the variable speed pump and thus the addition of additives such as frother and collector to the flotation cell. Basically, since the resistance of the photosensor is related to the reflectivity of the coal slurry in the tailings, and the reflectivity of the slurry depends on the coal content, then the resistance of the cell can be correlated to the coal content to monitor coal recovery in the flotation cell.

Figure 2:
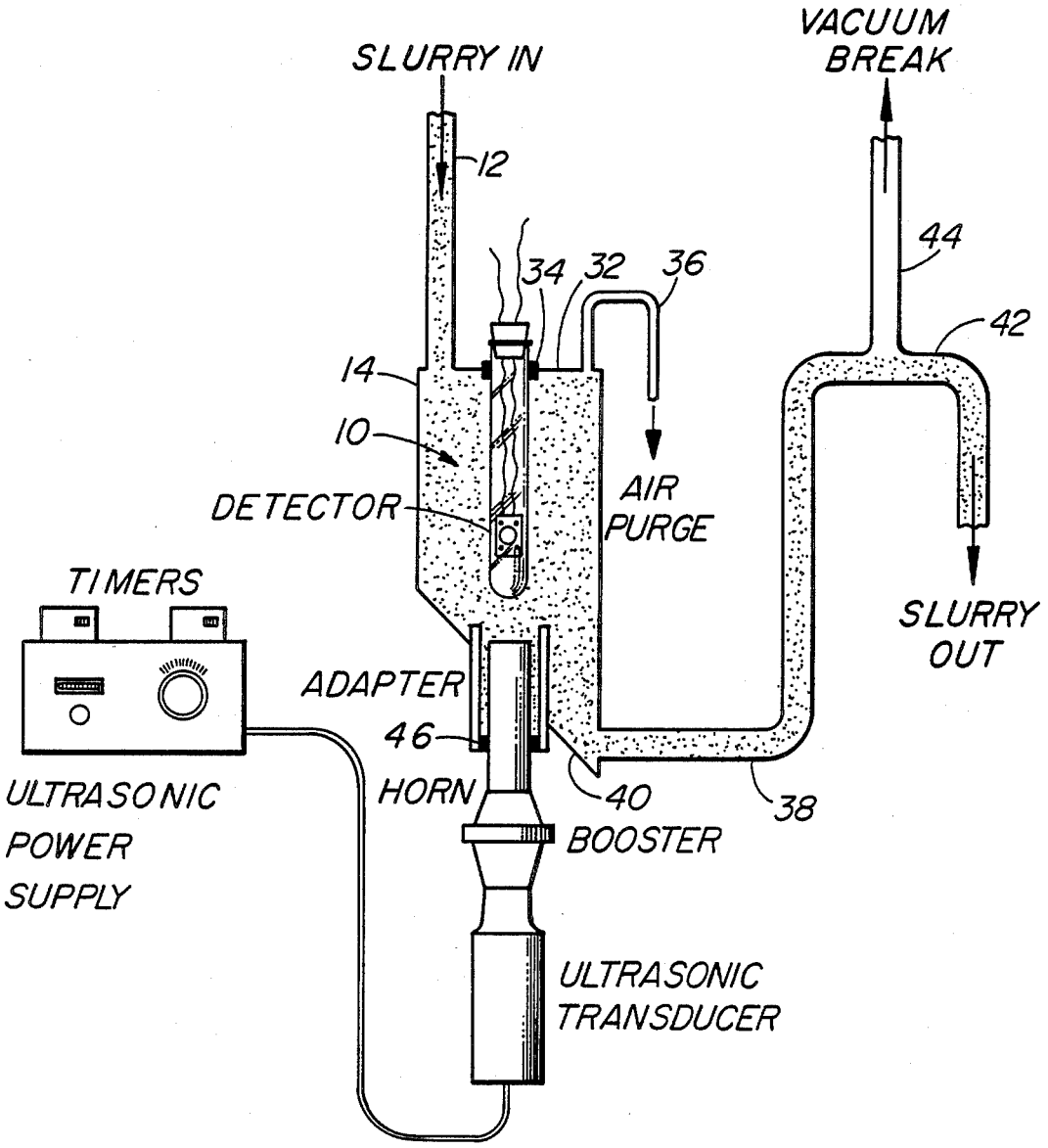
FIG. 2 is a plan view of the novel apparatus for detecting the coal content in the tailings from the flotation cell.
Figure 4:
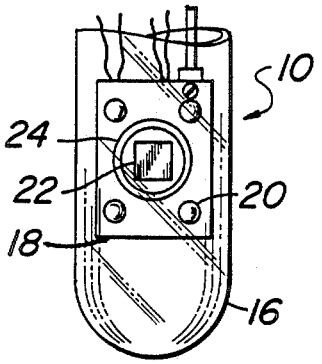
FIG. 4 is a plan view of the sensor portion of the detector.

Referring to FIG. 2, the detector 10 is secured in the upper end 32 of canister 14 by a seal 34 and extends downwardly into the slurry in the canister. An air purge line 36 passes any entrained air out of the canister 14 and the slurry passes out of line 38 connected to the lower sloped surface 40 of the canister. The line 38 extends upwardly to a U-shaped extension 42 above the upper end 32 of the canister to assure that the canister remains full. Rocks and other large particles travel down the slopped surface 40 of the canister, out line 32 up the extension 42 and out for disposal (The vacuum break 44 permits the slurry to pass out the discharge without siphoning out the contents of the canister). In this fashion, it can be seen that the configuration of the canister, air purge line 36 and output line 38 permits air to be purged, the canister to remain full and the rocks and slurry to be transferred out of the canister and discharged.

It has been determined that for the above described detector to continuously operate at optimum efficiency, it must emit a constant amount of light which makes the use of LED's preferable for this application. However, other sources of constant light are considered to be within the scope of this invention. Additionally, the exposure of the tube 16 to the slurry, coats the tube over a period of time decreasing the accuracy of the sensor. It has been determined that the vibration caused by periodic short bursts of ultrasonic energy will remove any deposits on the tube 16.

To this end (see FIGS. 1 and 2), an ultrasonic transducer is coupled through a booster to a horn passing through a seal 46 in the sloped bottom surface 40 of canister 14. An ultrasonic power supply controlled by timers will periodically energize the transducer to activate the horn to vibrate the slurry and remove any surface coating on the tube affecting operation of the detector.

It can thus be seen from the described method and apparatus, the physical properties of coal content of the flotation cell tailings can be detected and utilized to control the flotation cell to optimize coal removal from the cell.

We claim:

1. Method of controlling the operation of a flotation cell to which additives such as a frother and collector are added for extracting coal from a coal slurry; comprising (a) coacting a light sensitive detector with the slurry to determine the coal content of the slurry, and (b) adjusting the flow rate of additives to the flotation cell in response to the function of the detector.

2. The method of claim 1 including providing a light source and light detector submersed in the slurry to detect the amount of backscattered light.

3. The method of claim 2 including vibrating said slurry to remove debris therefrom to optimize detector efficiency.

4. The method of claim 1 including transmitting the output of said detector to a controller of a variable speed pump supplying additives to the flotation cell.

5. A system for separating ash forming impurities from coal in a slurry comprising:

(a) a flotation cell adapted to receive coal and remove ash forming impurities;

(b) a source of frother and collector and variable means to supply frother and collector to said flotation cell;

(c) said flotation cell having outlet means to transport a coal slurry residue therefrom; and (d) means associated with said outlet means including means responsive to the coal content of the slurry residue to control the function of said variable means.

6. The system of claims 5 wherein said responsive means is a photoelectric sensor detecting the amount of coal in the slurry residue to control said variable means.

7. The system of claim 6 including a transmitter and process controller interfacing with said sensor and said variable means.

8. The system of claim 6 wherein said associated means includes a canister for receipt of the slurry residue, said sensor being disposed within said canister and having a light emitting means and a light sensor detecting the light backscattered from the slurry to detect the coal content of the slurry.

9. The system of claim 5 wherein said responsive means is a light-emitting diode and said light sensor is a photoconductor cell, said photoconductor being isolated from said diode by an opaque shield so that only backscattered light from the slurry is sensed by said photoconductor cell.

10. The system of claim 9 wherein said light emitting means and said photoconductor cell are confined with a transparent container.

11. The system of claim 10 including means to supply ultrasonic energy to vibrate the slurry to remove debris from said transparent container.

* * * * *